US006088426A

United States Patent [19]

Miller

[11] Patent Number: 6,088,426

[45] Date of Patent: Jul. 11, 2000

[54] GRAPHITE X-RAY TARGET ASSEMBLY

[75] Inventor: Robert S. Miller, Sandy, Utah

[73] Assignee: Varian Medical Systems, Inc., Palo Alto, Calif.

[21] Appl. No.: 09/085,485

[22] Filed: May 27, 1998

[51] Int. Cl.[7] ..... H01J 35/10

[52] U.S. Cl. ..... 378/144; 378/143; 378/121; 378/125

[58] Field of Search ..... 378/125, 144, 378/121, 143

[56] References Cited

U.S. PATENT DOCUMENTS

| | | | |
|---|---|---|---|
| 3,795,832 | 3/1974 | Holland | 378/127 |
| 3,969,131 | 7/1976 | Fatzer et al. | 378/144 |
| 4,276,493 | 6/1981 | Srinivasa et al. | 378/144 |
| 4,394,953 | 7/1983 | Sonnweber et al. | 228/124.1 |
| 4,481,655 | 11/1984 | Annis et al. | 378/125 |
| 4,736,400 | 4/1988 | Koller et al. | 378/144 |
| 5,530,733 | 6/1996 | Eggleston et al. | 378/125 |
| 5,547,410 | 8/1996 | Eggleston et al. | 445/28 |
| 5,577,093 | 11/1996 | Benz et al. | 378/125 |

FOREIGN PATENT DOCUMENTS

| | | |
|---|---|---|
| 0 229 697 | 7/1987 | European Pat. Off. . |
| 0 653 733 | 5/1995 | European Pat. Off. . |

*Primary Examiner*—David V. Bruce
*Assistant Examiner*—Allen C. Ho
*Attorney, Agent, or Firm*—Bradford L. Friedman; Bella Fishman

[57] ABSTRACT

An x-ray target assembly is formed by passing a rotary shaft through the center hole of a graphite disk such that the back surface of the disk rests on a flange part of the rotary shaft and the front surface is contacted by a nut which engages with the tip of the rotary shaft. Annular brazing materials are placed adjacent contact areas where the disk contacts the rotary shaft and the nut such that braze joints are made to secure the disk with the nut and the rotary shaft. Grooves may be formed on the surfaces of the nut and the flange part of the rotary shaft which contact the disk such that the brazing material can more efficiently fill the gaps between contacting surfaces.

8 Claims, 1 Drawing Sheet

GRAPHITE X-RAY TARGET ASSEMBLY

BACKGROUND OF THE INVENTION

This invention relates to a rotary target assembly for an x-ray tube having a graphite disk secured to a rotary shaft, and a method of securing the graphite disk firmly to the rotary shaft to make such rotary target assembly.

Graphite target disks have been utilized for rotating anode x-ray tubes in the prior art designs. Advantages of their use have been described, for example, in the U.S. Pat. Nos. 4,276,493 and 4,481,655. However, the attachment of the graphite disk to a rotary shaft has been one of the major problems. The graphite target body became loose on the rotary shaft after being accelerated and decelerated many times during the operation.

An attempt to solve this problem has been disclosed in U.S. Pat. No. 4,736,400 claiming a method of attachment of the graphite disk and the rotary shaft by diffusing one portion of brazing material into the graphite disk and another portion into a flange being a part of the rotary shaft. With this method, however, the position of the graphite disk with respect to the flange may not be accurately controlled when the brazing material is melted.

SUMMARY OF THE INVENTION

It is therefore an object of the present invention to provide a rotary target assembly for an x-ray tube having a graphite disk securely and accurately attached to a rotary shaft.

It is another object of this invention to provide a method for securely and accurately attaching a graphite target disk for a rotating anode x-ray tube to its rotary shaft.

A target assembly embodying this invention, with which the above and other objects and advantages can be accomplished, comprises a graphite disk with a central hole, a rotary shaft having an annular supporting surface and a nut wherein these components are brazed together with a brazing material filling the gaps therebetween. The outer surfaces of the graphite disk may be covered with a metal carbide coating. During the assembly process the rotary shaft is passed through the central hole of the graphite disk such that the back surface of the disk rests on the annular supporting surface of the shaft, a nut is screwed on around the tip of the shaft until it comes into contact with the front surface of the disk. At least one annular brazing material is placed adjacent a gap formed between two contacting surfaces of the aforementioned components of the assembly and it is brazed so that the material will fill the gap to make the attachment secure and firm. According to a preferred embodiment of the invention, grooves are formed on the annular supporting surface and/or the surface of the nut contacting the front surface of the graphite disk such that the brazing material can easily flow therethrough to fill the gap between the two contacting surfaces intended to be attached together securely and firmly.

BRIEF DESCRIPTION OF THE DRAWINGS

The accompanying drawings, which are incorporated in and form a part of this specification, illustrate a preferred embodiment of the invention and, together with the description, serve to explain the principles of the invention. In the drawings.

These figures are intended to be merely schematic. They are not intended to represent any accurate dimensional relationships among the components.

DETAILED DESCRIPTION OF THE INVENTION

Figure 2:
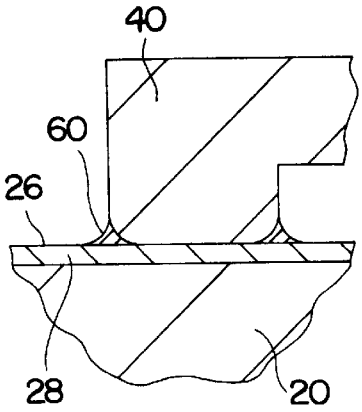
FIG. 2 is an enlarged view of a part of the rotary target assembly indicated by numeral 2 in FIG. 1 where brazing has been effected.
Figure 3:
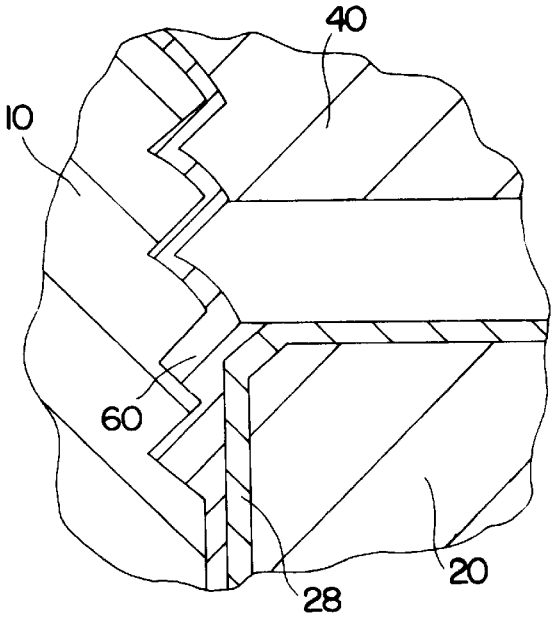
FIG. 3 is an enlarged view of a part of the rotary target assembly of FIG. 1 indicated by numeral 3 in FIG. 1 where brazing has been effected.

The present invention is described with reference to FIGS. 1, 2 and 3.

Rotary shaft 10 connected to a drive motor (not shown) and adapted to rotate around its longitudinal axis. Flange 12 is formed integrally with rotary shaft 10, having an annular mounting surface 14 around shaft 10 and perpendicular to its axial direction. At the tip, the outer peripheral surface of shaft 10 is threaded so as to serve as a male screw.

The body of the x-ray tube target comprises graphite disk 20 having central hole 22 for shaft 10 to be passed therethrough. One surface of graphite disk 20, that adapted to rest on and supported by annular mounting surface 14 of flange 12 is herein referred to as its back surface 24. The surface of graphite disk 20 being opposed to back surface 24 is referred to as front surface 26. When disk 20 is mounted on flange 12 as shown in FIG. 1, the male screw part of shaft 10 protrudes from front surface 26. The outer surfaces of graphite disk 20, inclusive of not only its front surface 26 and back surface 24 but also the inner surface bordering central hole 22 is covered by metal carbide coating 28. The metal carbide coating may comprise, for example, niobium carbide, tungsten carbide and tantalum carbide, which is formed by chemical vapor deposition inside a vacuum furnace or plasma spray or physical vapor deposition.

Annular nut 40 with central hole 42 and a threaded inner surface facing central hole 42 serves as a female screw engageable with the male screw around rotary shaft 10. One of its surfaces, facing front surface 26 is indented around central hole 42 from the outer peripheral area. Both rotary shaft 10 inclusive of flange 12 and nut 40 may comprise TZM.

After graphite disk 20 is mounted to annular mounting surface 14 of flange 12 around rotary shaft 10, annular nut 40 is fastened to rotary shaft 10 with its female screw engaging the male screw around rotary shaft 10 such that graphite disk 20 is sandwiched and supported between annular nut 40 contacting its front surface 26 and mounting surface 14 of flange 12 contacting its back surface 24.

Figure 1:
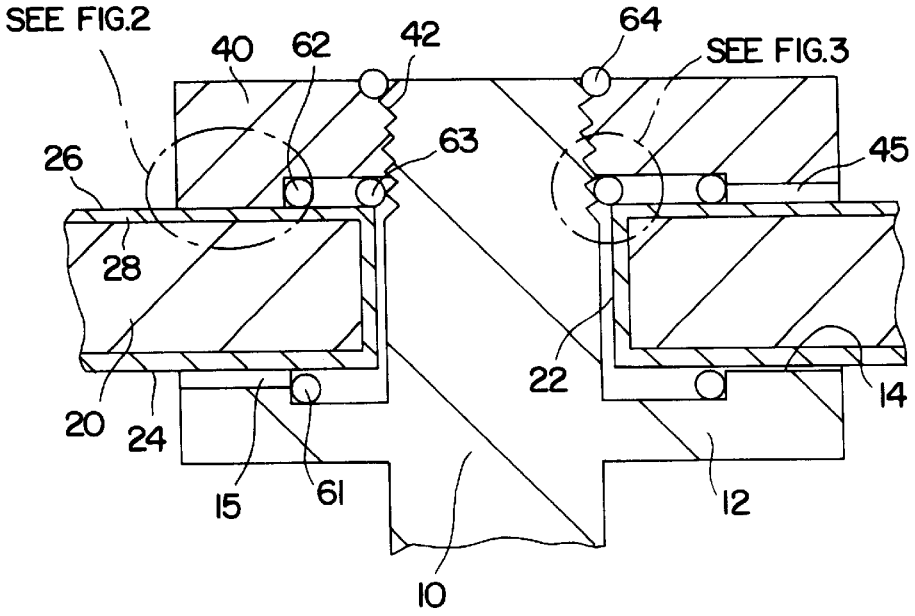
FIG. 1 is a schematic sectional view of a rotary target assembly for an x-ray tube embodying the present invention before the brazing process, showing the possible positions of an annular brazing material.

Before graphite disk 20 is mounted to annular mounting surface 14 of flange 12, a brazing material in an annular shape may be placed as indicated by numeral 61 in FIG. 1 between back surface 24 of graphite disk 20 and surface of flange 12 opposite thereto and adjacent annular mounting surface 14. Before annular nut 40 is attached to rotary shaft 10 as explained above, a similarly shaped annular brazing material may be placed at either or both of the positions indicated by numerals 62 and 63 inside the indentation on the surface of nut 40 adjacent respectively to the protruded outer peripheral area and to the externally threaded male screw part of rotary shaft 10. In addition, still another similarly shaped annular brazing material may be placed on the opposite surface of nut 40 (distal from graphite disk 20) as a position indicated by numeral 64 where the female screw on nut 40 and the mail screw on rotary shaft 10 contact each other.

These brazing materials (collectively indicated by numeral 60 in FIGS. 2 and 3) are heated (or at least one thereof) for making braze joints, flowing into the space in the gap between two contacting surfaces. These braze joints may be formed between back surface 24 of graphite disk 20 and mounting surface 14 of flange 12 with brazing material 61, between the protruding outer peripheral area of nut 40 and front surface 26 of graphite disk 20 with brazing material 62 as shown in FIG. 2, between the female screw on nut 40 and the male screw on rotary shaft 10 as well as between the inner wall of central hole 22 of graphite disk 20 and the outer peripheral surface of rotary shaft 10 with brazing material 63 as shown in FIG. 3, and between the female screw on nut 40 and the male screw on rotary shaft 10 brazing material 64.

According to the preferred embodiment of the invention, a plurality of grooves (for example, three grooves) 45 extending radially with respect to axis of rotary shaft 10 are formed across the protruding outer peripheral area of nut 40, equally spaced peripherally, such that the brazing material can move therethrough and more effectively reach the small spaces between nut 40 and front surface 26 of graphite disk 20. For the same purpose, a plurality of grooves (for example, three grooves) 15 are formed radially extending over mounting surface 14 of flange 12. These passages for the brazing material may be merely indented areas (not separately shown), formed equally spaced around the longitudinal axis of rotary shaft 10.

Rotary target assemblies for an x-ray tube according to this invention are more securely formed because of the brazing joints. The relative positions of the components can be more accurately controlled than by a method of diffusion brazing. Unlike prior art methods of brazing a metal washer or the like to the graphite disk and then clamping a nut tightly against it to secure the graphite disk to the rotary shaft, or clamping tightly with a compliant nut, the nut according to the present invention need not be tightened and hence the material properties of the graphite disk are not adversely affected.

Although the invention has been described with a certain degree of particularity, it is understood that the present disclosure of the preferred embodiment has been made only by way of examples. The rotary shaft may be attached to the graphite disk via securing means comprising a ring of brazed material that is disposed between an outer surface of the rotary shaft and an inner surface of the graphite disk opposite thereto. The active brazing may be utilized to eliminate the carbide coating between brazed surfaces. Other changes can be made to the design and method of the present invention without departing from its spirit and the scope of the appended claims.

What is claimed is:

1. A graphite x-ray target assembly comprising:

a graphite disk having a central hole, a front surface, a back surface and an inner surface bounding said central hole;

a rotary shaft penetrating said graphite disk through said central hole, said rotary shaft having an externally threaded part;

a flange being an integral with said rotary shaft, said flange having a mounting surface that contacts said back surface of said graphite disk around said rotary shaft;

a nut having an opening with a threaded inner wall engaging with said externally threaded part of said rotary shaft and an outer peripheral annular surface contacting said front surface of said graphite disk around said shaft; and a brazing material filling gaps at least at one contact region selected from the group consisting of contact region between said front surface of said graphite disk and said outer annular surface of said nut, contact region between said back surface of said graphite disk and said annular mounting surface of said flange, contact region between said inner surface of said graphite disk and said rotary shaft and contact region between said externally threaded part of said rotary shaft and said threaded inner wall of said nut, wherein said outer peripheral annular surface of said nut has a plurality of radially extending grooves for allowing said brazing material to move therethrough.

2. A graphite x-ray target assembly comprising:

a graphite disk having a central hole, a front surface, a back surface and an inner surface bounding said central hole;

a rotary shaft penetrating said graphite disk through said central hole, said rotary shaft having an externally threaded part;

a flange being an integral with said rotary shaft, said flange having a mounting surface that contacts said back surface of said graphite disk around said rotary shaft;

a nut having an opening with a threaded inner wall engaging with said externally threaded part of said rotary shaft and an outer peripheral annular surface contacting said front surface of said graphite disk around said shaft; and a brazing material filling gaps at least at one contact region selected from the group consisting of contact region between said front surface of said graphite disk and said outer annular surface of said nut, contact region between said back surface of said graphite disk and said annular mounting surface of said flange, contact region between said inner surface of said graphite disk and said rotary shaft and contact region between said externally threaded part of said rotary shaft and said threaded inner wall of said nut, wherein said annular mounting surface of said flange has a plurality of radially extending grooves for allowing said brazing material to move therethrough.

3. The x-ray target assembly of claim 1 or 2, further comprising a carbide coating which is deposited to said front surface, back surface and inner surface of said graphite disk.

4. The x-ray target assembly of claim 3, wherein said carbide coating comprises one selected from the group consisting of NbC, TaC and WC.

5. A method of producing a graphite x-ray target assembly comprising the steps of:

providing a graphite disk having a central hole, a front surface, a back surface and an inner surface that faces said central hole;

providing a rotary shaft that is rotatable around an axis, said rotary shaft having an externally threaded part and a flange that is attached to and rotates with said rotary shaft, said flange having an annular mounting surface around said rotary shaft;

providing a nut having an opening with a threaded inner wall engageable with said externally threaded part of said rotary shaft and an outer peripheral annular surface around said shaft;

protruding said rotary shaft through said central hole of said graphite disk and placing said back surface of said graphite disk to said mounting surface of said flange;

attaching said nut to said rotary shaft by engaging said threaded inner surface with said externally threaded part of said rotary shaft and thereby causing said outer annular surface of said nut to contact said front surface of said graphite disk;

placing at least one annular brazing material around said shaft at a position selected from the group consisting of a first position which is adjacent said outer peripheral annular surface of said nut and between said nut and said front surface of said graphite disk, a second position which is between said front surface of said graphite disk and said nut and contacts said externally threaded part of said rotary shaft, and a third position which is between said back surface of said graphite disk and said flange and adjacent said mounting surface; and heating said at least one brazing material to fill gaps between contacting surfaces adjacent said selected position, wherein said outer peripheral annular surface of said nut has a plurality of radially extending grooves connecting said opening with outside and said brazing material is caused to move through said grooves.

6. A method of producing a graphite x-ray target assembly comprising the steps of:

providing a graphite disk having a central hole, a front surface, a back surface and an inner surface that faces said central hole;

providing a rotary shaft which is rotatable around an axis, said rotary shaft having an externally threaded part and a flange which is attached to and rotates with said rotary shaft, said flange having an annular mounting surface around said rotary shaft;

providing a nut having an opening with a threaded inner wall engageable with said externally threaded part of said rotary shaft and an outer peripheral annular surface around said shaft;

protruding said rotary shaft through said central hole of said graphite disk and placing said back surface of said graphite disk to said mounting surface of said flange;

attaching said nut to said rotary shaft by engaging said threaded inner surface with said externally threaded part of said rotary shaft and thereby causing said outer annular surface of said nut to contact said front surface of said graphite disk;

placing at least one annular brazing material around said shaft at a position selected from the group consisting of a first position which is adjacent said outer peripheral annular surface of said nut and between said nut and said front surface of said graphite disk, a second position which is between said front surface of said graphite disk and said nut and contacts said externally threaded part of said rotary shaft, and a third position which is between said back surface of said graphite disk and said flange and adjacent said mounting surface; and heating said at least one brazing material to fill gaps between contacting surfaces adjacent said selected position, wherein said annular mounting surface of said flange has a plurality of radially extending grooves and said brazing material is caused to move through said grooves.

7. The method of claim 5 or 6, further comprising the step of depositing a carbide coating to said front surface, back surface and inner surface of said graphite disk, wherein said carbide coating comprises one selected from the group consisting of NbC, TaC and WC.

8. The method of claim 7, further comprising the step of placing another annular brazing material proximate to said threaded inner wall of said nut and said externally threaded part of said rotary shaft and brazing said brazing material so as to fill gaps between said externally threaded part of said rotary shaft and said threaded inner wall of said nut.

* * * * *